US006135300A

United States Patent [19]

Fox

[11] Patent Number: 6,135,300

[45] Date of Patent: Oct. 24, 2000

[54] PARAPET-MOUNTED HOIST

[76] Inventor: Merle Fox, 7245 N. 45th Ave., Glendale, Ariz. 85301

[21] Appl. No.: 09/397,859

[22] Filed: Sep. 17, 1999

[51] Int. Cl.[7] ..... B66C 23/20

[52] U.S. Cl. ..... 212/179; 182/60

[58] Field of Search ..... 212/179, 180; 187/240, 241, 242, 243, 244, 900; 182/57, 58, 59, 60, 61

[56] References Cited

U.S. PATENT DOCUMENTS

| | | | |
|---|---|---|---|
| 628,592 | 7/1899 | Terry | 212/179 |
| 845,143 | 2/1907 | Taylor | 212/179 |
| 1,010,530 | 12/1911 | Taylor . | |
| 1,247,706 | 11/1917 | Moran | 212/179 |
| 1,562,781 | 11/1925 | Moser | 187/900 |
| 1,650,656 | 11/1927 | Sasgen . | |
| 1,707,894 | 4/1929 | Bergesen | 182/60 |
| 2,513,403 | 7/1950 | Dakin . | |
| 2,623,643 | 12/1952 | Seamans . | |
| 2,881,029 | 4/1959 | Tollefsen | 182/144 |
| 3,391,906 | 7/1968 | Duerst . | |
| 3,888,368 | 6/1975 | Hawkins | 212/180 |
| 3,974,995 | 8/1976 | Blonde | 182/57 |
| 3,978,989 | 9/1976 | Avila, Jr. . | |
| 4,068,827 | 1/1978 | Fanning et al. . | |
| 4,621,741 | 11/1986 | Boon . | |
| 5,203,837 | 4/1993 | Madic et al. . | |
| 5,265,742 | 11/1993 | Stenger et al. . | |
| 5,341,898 | 8/1994 | Baziuk . | |
| 5,617,963 | 4/1997 | Baziuk et al. | 212/179 |
| 5,622,237 | 4/1997 | Moldow | 212/179 |
| 5,853,282 | 12/1998 | Bechler | 212/180 |

FOREIGN PATENT DOCUMENTS

| | | |
|---|---|---|
| 221348 | 9/1924 | United Kingdom . |
| 661209 | 11/1951 | United Kingdom . |
| WO 93/12029 | 6/1993 | WIPO . |

*Primary Examiner*—Thomas J. Brahan
*Attorney, Agent, or Firm*—Richard C. Litman

[57] ABSTRACT

A parapet-mounted hoist made from an elongated cradle. The cradle is essentially a rectangular box-shaped mounting frame having two pairs of mounting frame legs secured to the parapet with cradle bolts. A steel square tubed safety brace mount is seated between an inside surface of the cradle's top frame, and the parapet wall. The safety brace mount has a back segment extending slightly beyond a rear plane of the mounting frame, and a forward segment extending slightly beyond a front plane of the mounting frame. The safety brace mount has a threaded safety brace pin penetrating its wall. An elongated steel safety brace having a proximal end positioned within the back segment of the safety brace mount. A boom mount having a vertically oriented cradle stub is disposed on the outside surface of the cradle. The cradle stub has a lower end affixed to the outside surface, and an upper end supporting two parallel, horizontal mounting plates. A boom and an integral boom coupling rotate about a vertical axis defined by a boom mounting bolt through the boom mount. The boom passes directly over the safety brace and the parapet at 90 degrees from its loading position and at 90 degrees from its unloading position.

9 Claims, 4 Drawing Sheets

PARAPET-MOUNTED HOIST

BACKGROUND OF THE INVENTION

1. Field of the Invention

The present invention relates to construction equipment, and more particularly, to a hoisting apparatus mounted on a roof parapet.

2. Description of the Related of the Art

A great variety of devices for lifting objects to the roof of a building have been developed. Typically these devices may be used to lift construction materials or equipment during roofing construction or reconstruction. In many of the new commercial buildings having flat roofing, particularly those constructed within the past ten years, a relatively tall reinforced concrete parapet wall, often 4 to 6 feet in height, defines the roof perimeter. Prior to at least one relevant building code provision implementation pertaining to roof parapets, the parapets were typically constructed at a height of 2 to 3 feet. The newer buildings, having parapet walls of 4 to 6 feet, have been constructed to satisfy OSHA requirements, and to maintain the building appearance by blocking HVAC units, and any other mechanical equipment, from street view.

The taller parapet walls make it impossible to operate a standard roof-mounted boom or roof-anchored derrick. The tallest (40-foot) ladders will only accommodate heights of 34 feet, and hauling material or equipment by ladder is dangerous. As a result, with the 4 to 6 foot parapet walls, a contractor will have to rent a standard crane, which is operator assisted, expensive and inconvenient.

Thus, a light-weight lifting device is needed that can be easily and conveniently deployed within minutes, assembled and mounted onto the upper portion of a tilt-up panel, or other steel reinforced concrete parapet, for the purpose of hoisting miscellaneous materials, equipment and tools from the ground, over the parapet, and safely onto the roof, and the instant invention fills this need.

The related art discussed below is representative of developments prior to my invention.

U.S. Pat. No. 5,341,989, issued to Baziuk, M. in August 1994 describes a boom and pulley system for mounting on the edge of a flat roof. Baziuk, M. does not teach the present invention as claimed.

U.S. Pat. No. 5,265,742 issued to Stenger et al. in November 1993 describes a triangular shaped hoist apparatus attachable to a parapet wall, for lifting objects up and swinging them onto the roof. Stenger et al. do not teach the present invention as claimed.

U.S. Pat. No. 5,203,837 issued to Madic et al. in April 1993 describes a balanced lifting crane. Madic et al. do not teach the present invention as claimed.

U.S. Pat. No. 4,621,741 issued to Boon, C. W. in November 1986 describes a portable roof hoist having a horizontally shifting apex. Boon does not teach the present invention as claimed.

U.S. Pat. No. 4,068,827 issued to Fanning et al. in January 1978 describes a portable S-shaped hoist formed from truss members and having wheels. Fanning et al. do not teach the present invention as claimed.

U.S. Pat. No. 3,978,989 issued to Avila, F., Jr. in September 1976 describes an extensible and collapsible derrick having a roof stand and lateral support provided by a parapet wall. Avila does not teach the present invention as claimed.

U.S. Pat. No. 3,393,906 issued to Duerst, F. in July 1968 describes a hoisting apparatus with a swingable boom and tackle. Duerst does not teach the present invention as claimed.

U.S. Pat. No. 2,623,643 issued to Seamans, J. W. in December 1952 describes a scaffold raiser and remover that clamps to the upper edge of a tank and is further supported by an angled brace. Seamans does not teach the present invention as claimed.

U.S. Pat. No. 2,513,403 issued to Dakin, L. F. in July 1950 describes a triangulated T-shaped hoist having a triangular support frame attachable to a short wall. Dakin, L. F. does not teach the present invention as claimed.

U.S. Pat. No. 1,650,656 issued to Sasgen, M. J. in November 1927 describes a semi-portable derrick having a truss-shaped boom, and mountable on a post or column. Sasgen does not teach the present invention as claimed.

U.S. Pat. No. 1,010,530 issued to Taylor, J. L. in December 1911 describes a portable derrick mounted to a column attached top an L-shaped bracket. Taylor does not teach the present invention as claimed.

British Patent No. 221,348 published in September 1924 describes a hand-operated crane. British Patent No. 221,348 does not teach the present invention as claimed.

British Patent No. 661,209 published in November 1951 describes a ship crane having a pole-mounted boom. British Patent No. 661,209 does not teach the present invention as claimed.

PCT Publication No. WO 93/12029 published in June 1993 describes a portable crane for use on a utility truck. PCT Publication No. WO 93/12029 does not teach the present invention as claimed.

None of the above inventions and patents, taken either singularly or in combination, is seen to describe the instant invention as claimed. Thus a concrete tilt up panel wall lifting device solving the aforementioned problems is desired.

SUMMARY OF THE INVENTION

The present invention is a parapet-mounted hoist, comprising an elongated cradle having a rectangular box-shaped mounting frame, and a first and second pair of mounting frame legs extending from the mounting frame. The mounting frame is made from a rectangular inside frame, a rectangular outside frame, and a horizontally oriented rectangular top frame. The inside frame and the first pair of mounting frame legs are secured to the parapet with cradle bolts.

A steel square tubed safety brace mount is disposed longitudinally between the top frame and the parapet wall. The safety brace mount has a back segment extending slightly beyond a rear plane of the mounting frame, and a forward segment extending slightly beyond a front plane of the mounting frame. The safety brace mount has a threaded safety brace pin penetrating through a wall of the forward segment.

An elongated steel safety brace has a proximal end within the back segment of the safety brace mount. The safety brace also has a distal end extending substantially forward of the front plane of the forward segment of the mounting frame.

A boom mount having a vertically oriented cradle stub is disposed mid-way between the front plane and the rear plane. The cradle stub has a lower end affixed to two horizontal members of the outside frame, and an upper end supporting two parallel, horizontal mounting plates. A boom and an integral boom coupling rotate about a vertical axis defined by a boom mounting bolt. The boom passes directly over the safety brace and the parapet at 90 degrees from its loading position and at 90 degrees from its unloading position.

Accordingly, it is a principal object of the invention to provide a simple, light-weight lifting device that can be mounted solely to a steel-reinforced parapet wall without additional bracing or anchoring.

It is another object of the invention to provide a lifting device that is suited for use on roofs having tilt-up concrete panel walls that rise 4 feet or more above the roof surface.

It is a further object of the invention to provide a lifting device that can be quickly assembled, disassembled, and operated by a single person from the roof.

Still another object of the invention is to provide a roof-mounted lifting device with a sturdy cradle structure that increases safety and decreases required manpower and expense.

It is an object of the invention to provide improved elements and arrangements thereof for the purposes described which is inexpensive, dependable and fully effective in accomplishing its intended purposes. These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
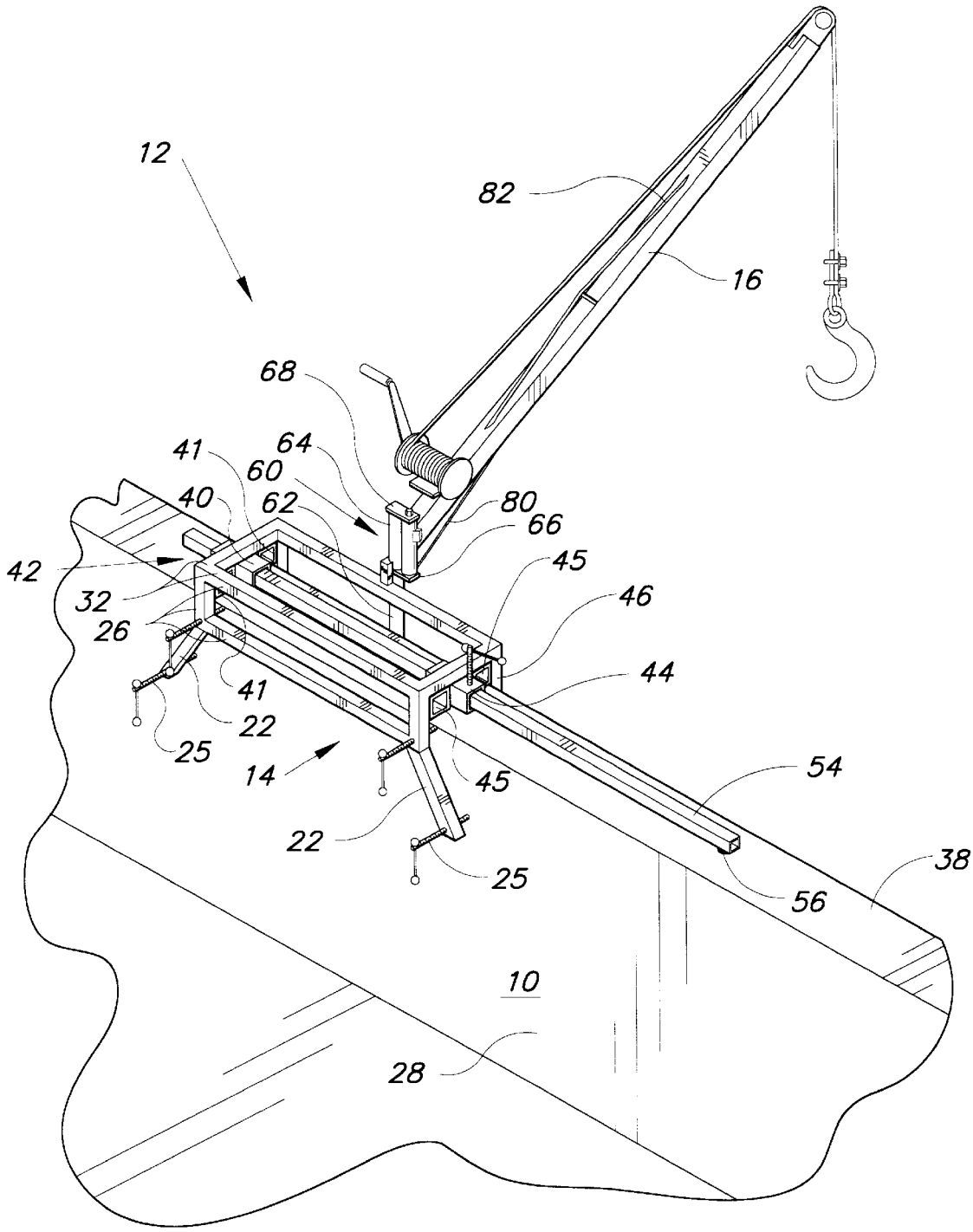
FIG. 1 is an environmental, perspective view of a concrete tilt up panel wall lifting device according to the present invention.

As shown in its operation environment of FIG. 1, the present invention is a hoist 12 mountable to a parapet (sometimes referred to as parapet wall) 10. Hoist 12 essentially comprises three components, best shown in FIG. 2. These three components are an elongated cradle 14, a boom 16, and a safety brace 18. Cradle 14 and brace 18 are elongated members extending along wall 10. Boom 16 is designed to rotate such as to maintain an average and mean position directly over brace 18 to maximize the stability of boom 16 as it performs work.

Cradle 14 comprises a rectangular box-shaped mounting frame 20 and a first pair 22 and a second pair 24 of steel square tubed mounting frame legs extending from the base of mounting frame 20. Cradle 14 is preferably formed from steel square tubing, preferably 1¾ inch, and 0.090 gauge.

Mounting frame 20 has a longitudinal axis parallel to the length of parapet 10, and is comprised of three parts: (a) a vertically oriented rectangular inside frame 26 that hugs an inner surface 28 of parapet 10; (b) a vertically oriented rectangular outside frame 30, opposite from and parallel to inside frame 26 (note: outside frame 30 hugs an outer surface (not shown) of parapet 10); and (c) a horizontally oriented rectangular top frame 32 that is normal to, connects, and shares a major upper member 34 with, each of inside frame 26 and outside frame 30.

Cradle 14 has a C-shaped profile on any plane normal to the longitudinal axis of cradle 14. The C-shaped profile substantially contours an upper portion of parapet wall 10. Each of the first pair 22 of mounting frame legs extends down and longitudinally away from inside frame 26 so as to maintain an obtuse angle with the lower horizontal member of inside frame 26. Each of the second pair 24 of mounting frame legs extends down and longitudinally away from outside frame 30 so as to maintain an obtuse angle with the lower horizontal member of outside frame 30. An obtuse angle is necessary in order to maximize the dispersion of forces upon parapet 10, said forces created by operation of boom 16 and cradle 14.

Pair 22 angles down and away within the plane of inside frame 26 and pair 24 angles down and away within the plane of outside frame 30. An inside surface of each pair of cradle legs is flush with an inside surface of each of frames 26 and 30, enabling the device or assembly to act as a wall clamp. Preferably, the cradle width, that is, the inside to inside dimensions between inside frame 26 and outside frame 30 is 7 and ¾ inches. The fact that the cradle width is at least ¼ inch less than 8 inches is a safety feature that will prevent hoist 12 from being used on 8 inch concrete block walls—that are typically not steel reinforced. The purpose of the mounting frame legs is to widen, deepen and essentially disperse the forces upon wall 10 caused by mounting frame 20 specifically, and by hoist 12, in general.

For example, according to the preferred embodiment, frame leg pairs 22 and 24 act to increase the spread of forces upon wall 10 from a width of twenty inches to a width of forty inches, and increases the depth of that spread by at least ten inches. Inside frame 26 and first pair 22 of the mounting frame legs is secured to the parapet with cradle bolts 25 that are preferably threaded through inside frame 26 and pair 22 of mounting frame legs. Bolts 25 are preferably 4 inch T-bolts.

Figure 3:
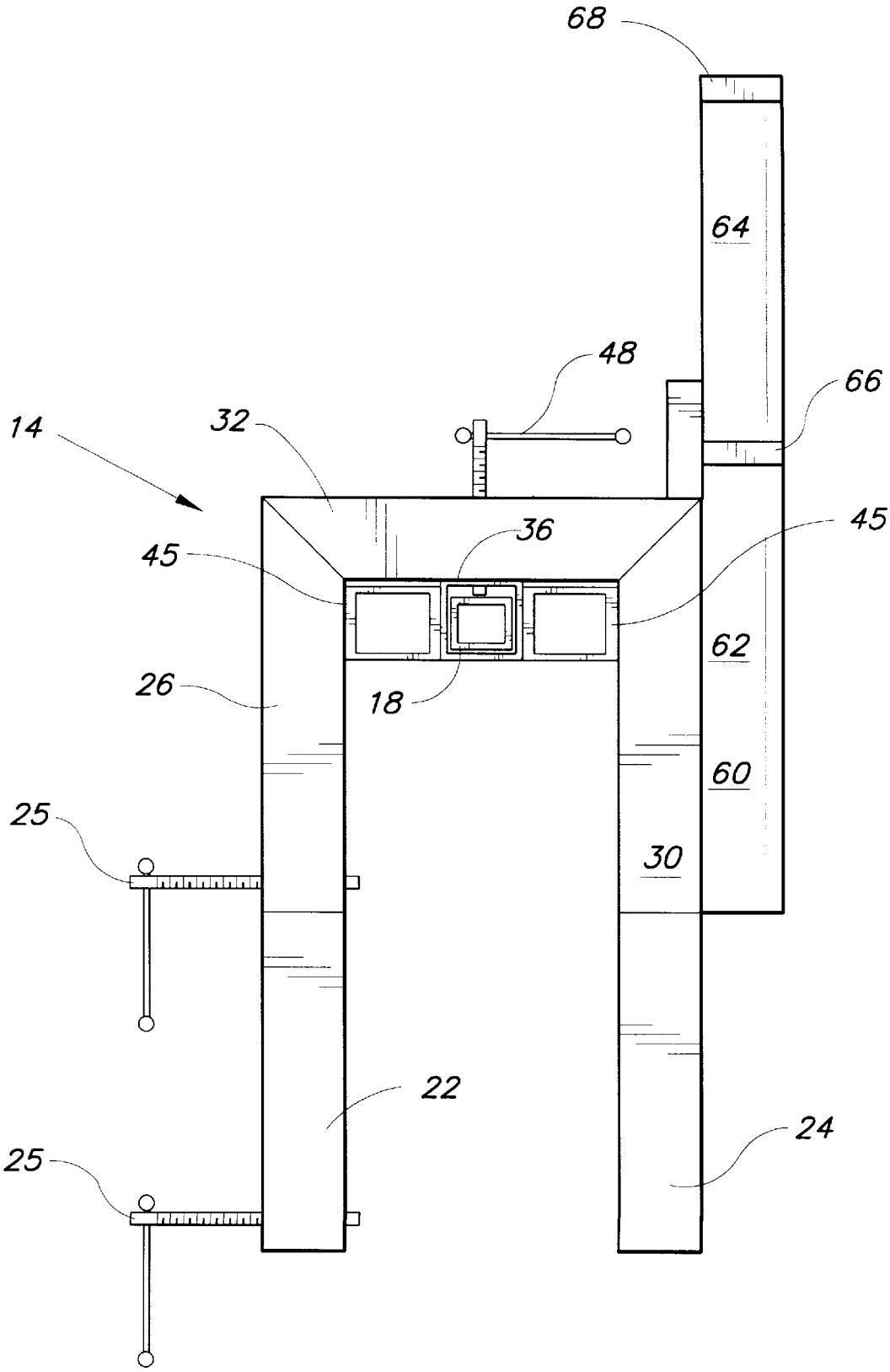
FIG. 3 is a front end view of the cradle and cradle stub of the lifting device.
Figure 4:
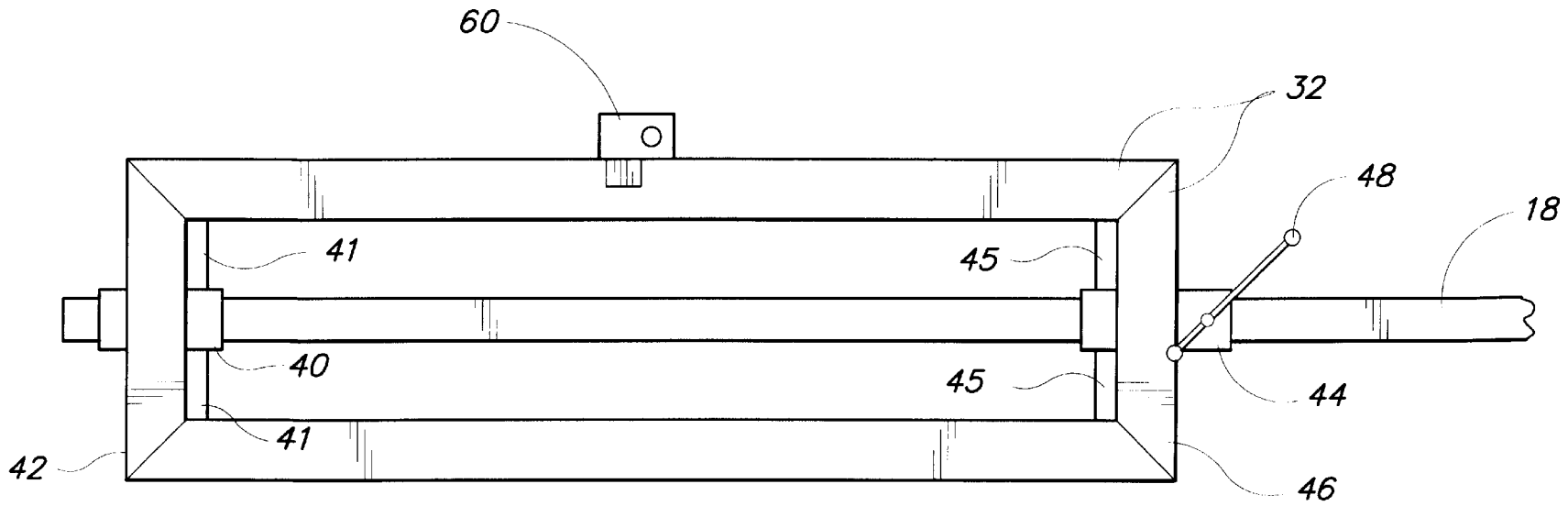
FIG. 4 is a top view of the cradle, the safety brace mount and the safety brace of the lifting device.

As best shown in FIG. 3, a horizontally disposed steel square tubed safety brace mount 36 is disposed longitudinally along, and between top frame 32 and a top surface 38 of, parapet wall 10. As shown in FIG. 4, mount 36 has a back segment 40 which extends slightly beyond rear plane 42 of mounting frame 20. Mount 36 has a forward segment 44 extending slightly beyond a front plane 46 of mounting frame 20. Each of segments 40 and 44 are 1¾ inch steel square tubing having a length of 4 inches. Each of segments 40 and 44 have mount supports 41 and 45, respectively. Safety brace mount 36 has a threaded safety brace locking pin 48 penetrating through a forward segment 44 wall of safety brace mount 36.

Figure 2:
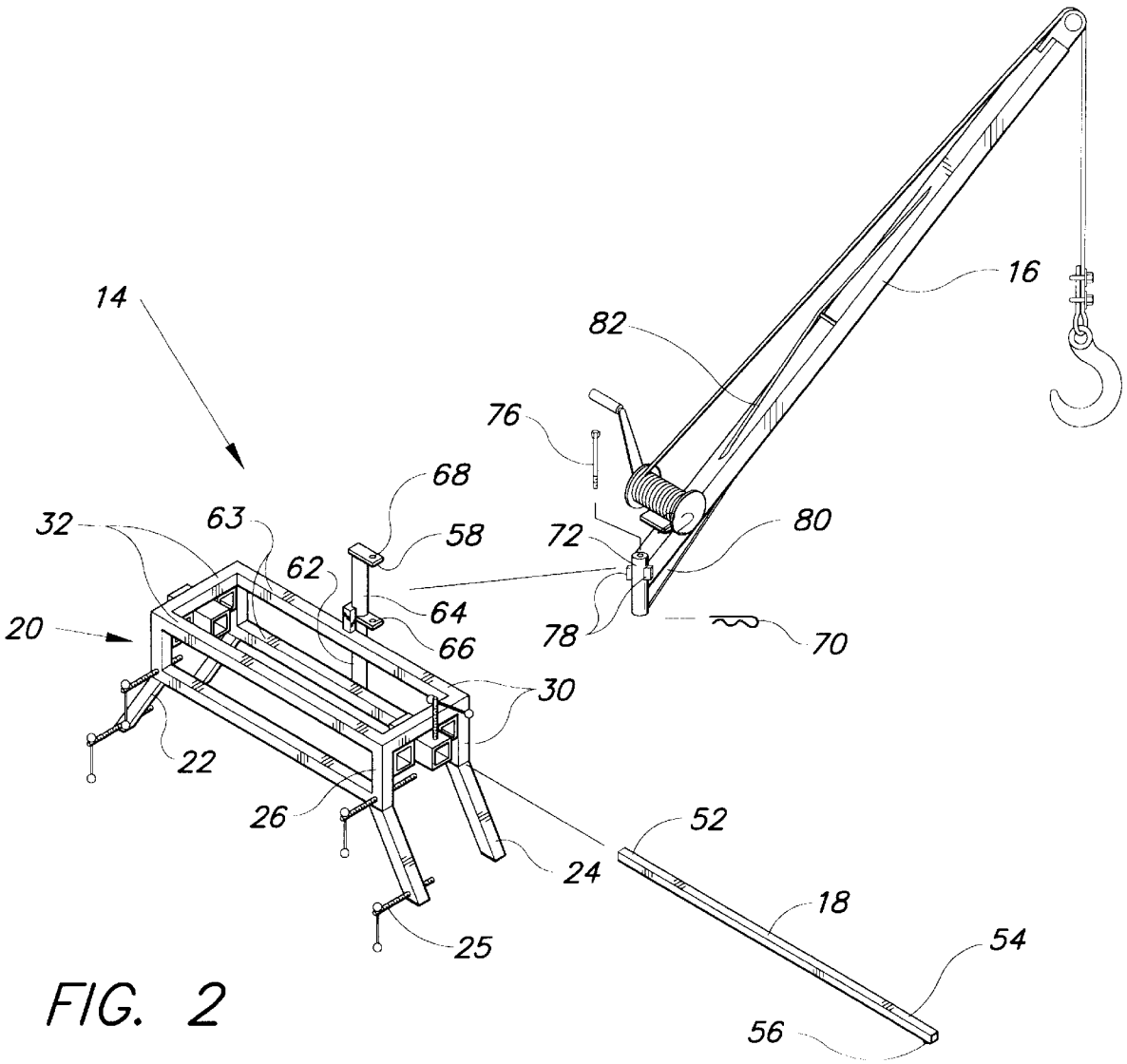
FIG. 2 is an exploded perspective view of the lifting device.

As shown in FIG. 2, an elongated steel safety brace 18 has a proximal end 52 slidably receivable within safety brace mount 36 to a distance sufficient to insert into back segment 40, and a distal end 54 extendible substantially forward of front plane 46 of mounting frame 20. Distal end 54 is supported on its lower surface by a safety brace foot 56 having a height equal to the wall thickness of safety brace mount 36 such that said safety brace 18 is level in a horizontal plane.

Referring to FIGS. 2 and 3, a boom mount 58 comprising a vertically oriented cradle stub 60 disposed mid-way between front plane 46 and rear plane 42, stub 60 having lower end 62 affixed to two horizontal members 63 of outside frame 30, and an upper end 64 supporting two parallel, horizontal mounting plates 66, 68. The lower plate 66 preferably has dimensions of ½ inch thick by 2 inches wide by 2 and ⅛ inches long, and is at least 1 inch above top frame 32 to accommodate a hitch pin 70. Upper plate 68 preferably has dimensions of ½ inch thick by 2 inches wide by 4 and ⅛ inches long. Lower plate 66 and upper plate 68 plate project forward to receive and capture a boom coupling 72 therebetween.

Each mounting plate 66, 68 has a hole therethrough to receive a boom mounting bolt 76, secured at its base by push clip 70, or carter key, or equivalent safety clip. Boom 16 is integral with boom coupling 72, Boom 16 and boom coupling 72 are capable of rotating about a vertical axis defined by boom mounting bolt 76. Boom coupling 72 has two safety lugs 78 to limit rotation of boom 16 to a 180 degree arc. Boom 16 is capable of rotating from a position normal to the longitudinal axis of the cradle 14 over the front plane 46, but is prevented from rotating over the rear plane 42 by coaction of safety lugs 78 with stub 60.

In operation, boom 16 passes directly over safety brace 18 and parapet 10 at 90 degrees from its loading position, over the roof's edge, and at 90 degrees from its unloading position, above the roof deck. Boom 16 further comprises a supporting gusset 80 and a stress tube safety device 82. Device 82 is preferably designed to fatigue and collapse when weights in excess of 500 pounds are hoisted. It is to be understood that the present invention is not limited to the embodiments described above, but encompasses any and all embodiments within the scope of the following claims.

I claim:

1. A parapet-mounted hoist, comprising:

an elongated cradle comprising a rectangular box-shaped mounting frame and a first and second pair of mounting frame legs depending therefrom, said mounting frame having a longitudinal axis parallel to the length of a parapet, said mounting frame having a vertically oriented rectangular inside frame for hugging an inner surface of the parapet, and a vertically oriented rectangular outside frame opposite from and parallel to said inside frame, said outside frame for hugging an outer surface of the parapet, and a horizontally oriented rectangular top frame normal to, connecting, and sharing a major upper member with, each of said inside frame and said outside frame, wherein said inside frame and said first pair of said mounting frame legs have cradle pins for securing them to the parapet.

a horizontally disposed steel square tubed safety brace mount disposed longitudinally between said top frame and said parapet wall, said safety brace mount having a back segment extending slightly beyond a rear plane of said mounting frame, and a forward segment extending slightly beyond a front plane of said mounting frame, said safety brace mount having a threaded safety brace pin penetrating through a wall of said forward segment;

an elongated steel safety brace having a proximal end slidably receivable within said back segment of said safety brace mount, and a distal end extending substantially forward of said front plane of said mounting frame;

a boom mount comprising a vertically oriented cradle stub disposed mid-way between said front plane and said rear plane, said outside frame having two horizontal members, there further being two parallel, horizontal mounting plates, said stub having a lower end affixed to said two horizontal members of said outside frame, and an upper end supporting said two parallel, horizontal mounting plates; and a boom integral with said boom coupling, said boom and said boom coupling rotatable about a vertical axis defined by said boom mounting bolt, said boom passing directly over said safety brace and said parapet at 90 degrees from its loading position and at 90 degrees from its unloading position, said boom further comprising a supporting gusset.

2. The device according to claim 1, wherein said cradle is formed from steel square tubing.

3. The device according to claim 1, wherein the inside to inside dimensions between said inside frame and said outside frame are 7 and ¾ inches or less, to prevent said hoist from being used on eight-inch non-reinforced concrete block walls.

4. The device according to claim 1, wherein said mounting frame has a C-shaped profile on any plane normal to the longitudinal axis of said cradle, said C-shaped profile substantially contouring an upper portion of said parapet wall, said first pair of mounting frame legs extending down and longitudinally away from a base of said mounting frame within the plane defining said inside frame, said second pair of mounting frame legs extending down and longitudinally away from said base of said mounting frame, parallel to said first pair.

5. The device according to claim 1, wherein said distal end is supported on its lower surface by a safety brace foot having a height equal to the wall thickness of said safety brace mount such that said safety brace can be level with said parapet.

6. The device according to claim 1, wherein the lower of said plates is at least 1 inch above said top frame, each of said plates projecting forward to receive and to capture a boom coupling, each of said plates having a hole therethrough to receive a boom mounting bolt secured at its base by a hitch pin or carter key.

7. The device according to claim 1, wherein said boom coupling has two safety lugs to limit rotation of said boom to a 180 degree arc.

8. The device according to claim 1, wherein a collapsible stress tube safety device is coupled to said boom.

9. A parapet-mounted hoist, comprising:

an elongated cradle comprising a rectangular box-shaped mounting frame and a first pair and a second pair of mounting frame legs depending therefrom, said mounting frame having a longitudinal axis parallel to the length of said parapet, said mounting frame having a vertically oriented rectangular inside frame for hugging an inner surface of said parapet, and a vertically oriented rectangular outside frame opposite from and parallel to said inside frame, said outside frame for hugging an outer surface of said parapet, and a horizontally oriented rectangular top frame normal to, connecting, and sharing a major upper member with, each of said inside frame and said outside frame, said mounting frame having a C-shaped profile on any plane normal to the longitudinal axis of said cradle, said C-shaped profile substantially contouring an upper portion of said parapet wall, said first pair of mounting frame legs extending down and longitudinally away from a base of said mounting frame within the plane defining said inside frame, said second pair of mounting frame legs extending down and longitudinally away from said base of said mounting frame within the plane defining said outside frame;

a horizontally disposed steel square tubed safety brace mount disposed longitudinally between an inside surface of said top frame, and said top surface of said parapet wall, said safety brace mount having a back segment extending slightly beyond a rear plane of said mounting frame, and a forward segment extending slightly beyond a front plane of said mounting frame, said safety brace mount having a threaded safety brace pin penetrating through a wall of said forward segment of safety brace mount, proximate said forward end;

an elongated steel safety brace having a proximal end slidably receivable within said back segment, and a distal end extending substantially forward of said front plane of said mounting frame, said distal end supported on its lower surface by a safety brace foot having a height equal to the wall thickness of said forward segment of said safety brace mount such that said safety brace can be level with an upper surface of said parapet;

a boom mount comprising a vertically oriented cradle stub disposed mid-way between said front plane and said rear plane, said outside frame having two horizontal members, there further being two parallel, horizontal mounting plates, said stub having a lower end affixed to said two horizontal members of said outside frame, and an upper end supporting said two parallel, horizontal mounting plates the lower of said plates being at least 1 inch above said top frame, there further being a boom coupling, a boom mounting bolt and a safety clip, each of said plates jutting forward to receive and to capture said boom coupling, each of said plates having a hole therethrough to receive said boom mounting bolt secured at its base by a safety clip; and a boom integral with said boom coupling, said boom and said boom coupling rotatable about a vertical axis defined by said boom mounting bolt, said boom coupling having two safety lugs to limit rotation of said boom to a 180 degree arc, said boom passing directly over said safety brace and said parapet at 90 degrees from its loading position and at 90 degrees from its unloading position, said boom further comprising a supporting gusset and a stress tube safety device.

* * * * *